US007246713B2

(12) United States Patent
King

(10) Patent No.: US 7,246,713 B2
(45) **Date of Patent: *Jul. 24, 2007**

(54) USER-FRIENDLY BOTTLE AND CLOSURE THREAD ASSEMBLY

(75) Inventor: Roger Milner King, Buckinghamshire (GB)

(73) Assignee: Beeson and Sons Limited, Rickmansworth (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/496,054

(22) PCT Filed: Nov. 19, 2002

(86) PCT No.: PCT/GB02/05184

§ 371 (c)(1),
(2), (4) Date: Nov. 4, 2004

(87) PCT Pub. No.: WO03/045806

PCT Pub. Date: Jun. 5, 2003

(65) Prior Publication Data

US 2005/0056613 A1 Mar. 17, 2005

(30) Foreign Application Priority Data

Nov. 20, 2001 (GB) ..... 0127836.5

(51) Int. Cl.
*B65D 41/04* (2006.01)

(52) U.S. Cl. ..... 215/330; 220/196

(58) Field of Classification Search ..... 215/330, 215/329, 307, 222, 331, 332, 208; 220/293, 220/296, 297, 300, 301, 298
See application file for complete search history.

(56) References Cited

U.S. PATENT DOCUMENTS 1,158,073 A * 10/1915 Payne ..... 220/258.3
1,612,449 A * 12/1926 Lee ..... 215/331
3,612,324 A * 10/1971 Malick ..... 215/222
3,880,314 A * 4/1975 Akers ..... 215/214

(Continued)

FOREIGN PATENT DOCUMENTS

GB 1 343 572 1/1974

(Continued)

*Primary Examiner*—Lien M. Ngo
(74) *Attorney, Agent, or Firm*—Stephen B. Salai, Esq.; Brian B. Shaw, Esq.; Harter Secrest & Emery LLP

(57) ABSTRACT

The invention provides a threaded container closure assembly includes: a container neck having an opening; a closure for said neck, the closure having a base portion and a skirt portion; a first screw thread on the neck, said first screw thread comprising one or more first thread segments; a second screw thread on an inner surface of the skirt of the closure, said second screw thread comprising one or more second screw thread segments; said first and second screw threads being configured to enable a user to secure, remove and resecure the closure into a sealing position on the neck by rotation of the closure on the neck; and wherein said first thread segments are shorter than said second thread segments; and wherein the second thread segments are each made up of one or more radially spaced projecting portions, each said portion extending radially no more than about 60° around the closure skirt.

26 Claims, 2 Drawing Sheets

U.S. PATENT DOCUMENTS

| | | | | |
|---|---|---|---|---|
| 4,032,028 | A * | 6/1977 | Reiss et al. | 215/217 |
| 4,739,890 | A * | 4/1988 | Cooke | 215/222 |
| 4,953,728 | A * | 9/1990 | Meek | 215/250 |
| 5,967,352 | A | 10/1999 | Repp et al. | |
| 6,006,930 | A * | 12/1999 | Dreyer et al. | 215/44 |
| 6,015,054 | A | 1/2000 | King et al. | |
| 6,227,391 | B1 | 5/2001 | King | |

FOREIGN PATENT DOCUMENTS

| | | | |
|---|---|---|---|
| GB | 2 138 574 | A | 10/1984 |
| GB | 2311285 | A | 9/1997 |
| GB | 2319513 | A | 5/1998 |
| GB | 2 330 133 | A | 4/1999 |

* cited by examiner

USER-FRIENDLY BOTTLE AND CLOSURE THREAD ASSEMBLY

BACKGROUND OF THE INVENTION

1. Field of the Invention

The present invention relates to improved threaded closure assemblies for containers. The invention also provides improved threaded closure caps.

2. Description of the Related Art

Current commercially mass-produced beverage containers use threads on the container neck and closure of the continuous, helical type. The threads comprise a single, substantially continuous thread portion on the container neck with a low thread pitch angle, typically less than 5°. The low pitch angle is needed in order to ensure that the closure does not unscrew spontaneously. The low pitch angle also provides the necessary leverage to achieve an air tight compressive seal between the closure and the container neck when the closure is tightened onto the container neck. The low pitch of the helical threads also means that the closure typically needs to be rotated through more than 360° to disengage it completely from the container neck.

Drawbacks of these low pitch helical threads include the laborious rotation required to remove and resecure the closure on the neck, excessive use of molding material to form the long helical threads, and unreliable separation of tamper-evident rings from the closure skirt due to the low pitch angle of the threads.

The present applicant has described an improved pressure safety closure for carbonated beverage containers in International Patent application WO95/05322. This application describes container closure assemblies having substantially continuous threads defining a substantially continuous helical thread path, although the pitch of the helix can vary. The closure can be moved from a fully disengaged to a fully secured position on the container neck by rotation through 360° or less. The threads on the neck or the closure are provided with mutually engageable elements to block or restrict rotation of the closure in an unscrewing direction beyond an intermediate position when the closure is under an axial pressure in a direction emerging from the container neck, the neck and closure being constructed and arranged to provide a vent for venting gas from the container neck at least when the closure is in the intermediate position. This pressure safety feature prevents the closure from blowing off uncontrollably once unscrewing of the closure from the container neck has started. It thus allows the use of shorter, more steeply pitched or multiple-start threads in the container and closure assembly, thereby rendering the assembly much more elderly- and child-friendly without sacrificing pressure safety. WO97/21602 and WO99/19228 describe improved versions of the assemblies of WO95/05322.

The beverage container closure assemblies exemplified in WO95/05322 have short projecting thread segments on the cap and longer projecting thread segments on the container neck. This arrangement is conventional, in part because of the requirements of high-speed injection molding of the caps, according to which the caps must be "bumped" off a (preferably) one-piece mold mandrel with minimum distortion.

Interestingly, the various screw-top formats for beverage containers have not yet completely replaced glass bottles with crown closures. This is despite the fact that crown closures require a bottle opener to open, and cannot be resecured on the bottle neck in airtight fashion, thereby making it necessary to consume the whole contents of such a bottle immediately after opening.

The present applicant considers that one of the reasons for the continued use of crown closures is that they are better suited for consumption directly from the bottle because the relatively smooth surfaces of the bottle neck are more comfortable between the consumer's lips. This characteristic will be referred to as the "user-friendliness" of the bottle neck. In contrast, screw top container necks have neck threads that present a relatively rough or abrasive surface to the lips.

It is an object of the present invention to provide improved screw top closure assemblies for containers. The present invention is especially applicable to beverage containers, including carbonated beverage containers.

BRIEF SUMMARY OF THE INVENTION

The present invention provides a threaded container closure assembly comprising: a container neck having an opening; a closure for said neck, the closure having a base portion and a skirt portion; a first screw thread on the neck, said first screw thread comprising one or more first thread segments; a second screw thread on an inner surface of the skirt of the closure, said second screw thread comprising one or more second screw thread segments; said first and second screw threads being configured to enable a user to secure, remove and resecure the closure onto a sealing position on the neck by simple rotation of the closure on the neck; wherein said first thread segments are shorter than the second thread segments, and wherein the second thread segments are each made up of a plurality of radially spaced projecting portions, each said portion extending radially no more than about 60° around the closure skirt The container neck is preferably formed from thermoplastic material, that is to say from a molded polymer, but it may be formed from glass.

The closure is preferably made from injection-molded thermoplastic, and it is a particular advantage of the present invention that the closures can easily be manufactured by high-speed injection molding, as will be described further below.

The mean inside diameter of the neck may be typical for carbonated beverage containers, for example about 1.5 to about 3 cm. In other embodiments the neck has a larger diameter to assist drinking or pouring from the neck, for example a mean inside diameter of from about 3 to about 8 cm, preferably from about 4 to about 6 cm.

Preferably, there are at least two of said first thread segments. More preferably, there are at least four of said first thread segments. In the larger neck formats especially there may be six, eight, ten, twelve or more of the first thread segments. The number of second thread segments is typically the same as the number of first thread segments. Preferably, this results in a number of thread starts equal to the number of first thread segments, or preferably at least two thread starts, more preferably at least four, such as six or eight thread starts.

The first thread segments on the container neck are shorter than the second thread segments. That is to say, they extend radially around the neck by a smaller angle than the angle through which the second thread segments extend around the closure skirt. Preferably, the first thread segments do not extend all the way around the neck, and preferably they do not overlap around the container neck. Preferably, at least one of the first thread segments extends circumferentially from about 1 to about 60 degrees around the container neck, more preferably from about 2 to about 45 degrees, more preferably from about 5 to about 30 degrees, more preferably from about 10 to about 20 degrees, and more preferably all of the first thread segments so extend. Preferably, the maximum length of each first thread segment is from about 2 to about 20 mm, more preferably from about 4 to about 15 mm, more preferably from about 6 to about 12 mm. Preferably, all of the first thread segments have substantially the same shape and configuration, whereby the number of thread starts may be equal to the number of first thread segments.

The term "first thread segment" typically refers to an elongate, pitched projection on the container neck. It does not typically refer to a simple projecting boss or peg. The mean pitch of the first thread segment surfaces is preferably from about 5° to about 25°, more preferably from about 10° to about 20°. The upper and lower surfaces of the first thread segments may have different pitches, and the pitch along one or other of said surfaces may also vary. Preferably, at least one of said surfaces has at least one constant pitch region extending for at least 5° around the container neck. For example, the first thread segment may be a short helical thread segment having rounded ends, similar to the thread segments on the closure caps described in detail in WO95/05322 or WO97/21602.

The first thread segments may be substantially triangular, rectangular, rounded or chamfered rectangular, or trapezoidal in cross-section along the longitudinal axis of the neck. Preferably, the first thread segments are smoothed. That is to say, at least one edge of the segments is shaped to present a rounded or chamfered cross-section along the longitudinal axis of the neck instead of a triangular, rectangular or trapezoidal cross-section between the side of the segment and the top of the segment. Preferably, substantially all of the edges of the segment are smoothed in this way. Preferably, this results in an increased radius of curvature between the top of the segment and the side of the segment relative to the prior art. For example the radius of curvature may be at least 0.5 mm, more preferably at least 1 mm or 2 mm. Preferably, the cross-section of the segments taken along the longitudinal axis of the neck is a substantially continuous curve such as a semicircle or sinusoidal curve. This smoothed profile improves the user-friendliness of the neck thread finish.

Preferably, the maximum radial height of the first thread segments above the cylindrical base of the neck finish is greater than 0.1 mm, more preferably greater than 0.2 mm and still more preferably from 0.5 to 3 mm, most preferably from 1 to 2 mm. Preferably, the width of the first thread segments (measured along the longitudinal axis of the container neck) is from 1 mm to 6 mm, more preferably from 2 mm to 4 mm. The use of such relatively large and high thread segments helps make it possible to produce a user-friendly neck finish onto which a suitable screw top can be secured and resecured in pressure-secure fashion. Nevertheless, the shortness of the first thread segments and the usual rounded or smoothed cross-section of the first thread segments enables the relatively high neck finish to be made user-friendly, in particular to be made comfortable to the lips of a user drinking directly from the neck.

Preferably, the second thread segments on the inside of the closure skirt define a substantially continuous helical thread path along which the first thread segments travel from a substantially fully disengaged to a substantially fully secured position of the closure on the container neck. That is to say, the first and second threads do not engage in a stepped fashion like a bayonet closure (which is normal for short thread segments), but rather in a conventional continuous helical screw fashion. In other words, the pitch of the thread path is normally less than 90 degrees throughout its length. It will be appreciated that the pitch of the helix may not be constant. Preferably, the mean pitch of the helical thread path is from 5 to 20 degrees for a typical carbonated beverage assembly as hereinbefore described. The pitch may differ for wide-mouth assemblies as hereinbefore described.

The continuous thread path renders the assembly especially easy to close by the elderly and infirm, or by children. In contrast, bayonet-type threads of the kind described in U.S. Pat. No. 5,135,124 require a relatively complex, stepped manipulation to secure the closure onto the container neck, with the result that the closure is often inadequately secured on the container neck. Furthermore, it is extremely difficult to devise a tamper-evident ring for the closure that separates reliably and easily upon opening of a bayonet-type closure assembly. Finally, a continuous thread is easier for physically weak people to screw down against pressure from inside the container than a bayonet thread.

The second thread segments are not bayonet-type thread segments. The second thread segments extend around the closure skirt a sufficient distance so that a top portion of one thread segment is proximate to a bottom portion of another thread segment, and preferably overlaps the other thread segment for a finite angular distance around the closure skirt. That is to say, preferably respective top and bottom portions of adjacent second thread segments are circumferentially overlapping. Preferably, at least one of the second thread segments extends for at least 45° around the closure skirt, more preferably at least 60° around the closure skirt, more preferably at least 90°. A thread gap is defined between the said top and bottom portions of the thread segments. One of the first thread segments travels through this thread gap as the closure is screwed onto or off the container neck.

Preferably, there are four, six or eight of the second thread segments. Preferably the first and second thread segments define a four-start, six-start or eight-start substantially continuous and fast-pitched thread path.

Preferably, the closure can be moved from a fully released to a fully engaged position on the container neck (or vice-versa) by a single smooth rotation through about 360 degrees or less, more preferably about 180 degrees or less, and most preferably about 90 degrees or less.

Preferably, the maximum radial height of the second thread segments above the cylindrical surface of the closure skirt is greater than about 0.1 mm, more preferably greater than about 0.2 mm and still more preferably from about 0.5 to about 3 mm, most preferably from about 1 to about 2 mm. Preferably, the width of the second thread segments (measured along the longitudinal axis of the closure skirt) is from about 1 mm to about 6 mm, more preferably from about 2 mm to about 4 mm.

The second thread segments are each made up of one or more radially spaced projecting portions, each said portion extending radially no more than about 60° around the closure skirt, preferably no more than about 45° around the closure skirt, more preferably from about 2° to about 35° around the closure skirt. The radially spaced projecting portions are preferably radially spaced apart by gaps extending radially from 0 to about 10°, preferably from about 0.5° to about 2°. Preferably, the width of gaps is from about 0.1 mm to about 5 mm, more preferably from about 0.5 mm to about 2 mm. In other words, the second thread is preferably a broken or interrupted thread having a plurality of gaps in each thread segment, but the gaps being sufficiently radially narrow not to interfere with the operation of the second thread segments. That is to say, the second thread segments still define a substantially continuous helical thread path therebetween. This requires the gaps in the second thread segments (as well as the gaps between the second thread segments) to be radially narrower than the first thread segments.

Preferably, each second thread segment is made up of at least two portions, preferably at least three or four portions, and this implies at least one or preferably at least two or three gaps in the thread segment. The presence of the gaps in the second thread segments may improve gas venting through the second thread when opening pressurised containers. More importantly, the closure caps are easier to bump off a one-piece mold mandrel during high speed manufacturing, because the broken threads offer less resistance to radial expansion of the closure skirt.

Preferably, at least one of the second thread segments also has a smoothed cross section. The second thread cross section is preferably complementary to the cross section described above for the first thread segments. It will be appreciated that this can result in a better fit between the first and second thread segments, for example if they have matching cross-sectional shapes parallel to the axis of rotation. Moreover, tapered or smoothed threads on the closure make it easier to bump the closure off a mold mandrel, thereby assisting high-speed manufacture of the closures by injection molding without the need for multi-part mold pieces.

The present invention is applicable to a wide variety of containers in which user friendliness is desirable, including containers for both carbonated and non-carbonated beverages. The present invention is applicable to molded thermoplastics container closure assemblies, and also to glass or metal container closure assemblies, and to combinations thereof (e.g. a glass container neck with a metal or thermoplastic closure).

Preferably, the container closure assembly according to the present invention further comprises complementary locking means on the container neck and the closure that resist unscrewing of the closure from the fully engaged position on the container neck after the closure has been secured or resecured on the container neck until a predetermined minimum opening torque is applied. These elements enable more steeply pitched threads and free running (parallel) threads to be used without risk of the closure unscrewing spontaneously. The use of more steeply pitched threads in turn makes it possible to use wider and higher thread segments within the size and height constraints of a normal neck finish.

Preferably, the locking means on the container neck comprises a projection or recess for engagement with a complementary projection or recess on the closure skirt. More preferably, the projection or recess on the container neck is smoothed as hereinbefore defined.

More preferably, the locking means comprise a longitudinal locking rib on the container neck, and a complementary locking ramp on the skirt portion of the closure, wherein the locking rib abuts against a retaining edge of the locking ramp when the closure is fully engaged on the container neck. In alternative preferred embodiments, a locking recess such as a longitudinal groove may be provided in one or more of the first or second thread segments, and a longitudinal locking rib is provided on the other of the container neck or on the skirt portion of the closure, whereby the locking rib is received in the recess in the thread segments at the fully engaged and sealing position of the closure on the container neck. Locking means of this kind are described in detail in WO91/18799 and WO95/05322, the entire disclosures of which are expressly incorporated herein by reference.

The complementary locking means provide a number of important advantages. Firstly, they prevent accidental backing off of the closure from the fully engaged and sealing position on the container neck due to pressure from inside the container. This also permits the use of more steeply pitched threads on the container neck and the closure. Furthermore, the locking means provide a positive "click" when the fully engaged and sealing position of the closure on the container neck is reached, thereby giving the user a positive indication of that position. This helps to ensure that exactly the right degree of compression is applied between the container and closure to achieve an effective airtight seal.

Preferably, the container closure assembly according to the invention is an assembly for a carbonated beverage, wherein the container further comprises mutually engageable elements on the neck and the closure to block or restrict rotation of the closure in an unscrewing direction beyond an intermediate position when the closure is under axial pressure in a direction emerging from the container neck. This is the so-called pressure safety feature that is intended to prevent the closure unscrewing uncontrollably or missiling as it is removed from a container neck under pressure. Preferably, the preferred embodiments of this pressure safety feature are as described in WO95/05322, WO97/21602 and WO99/19228, the entire contents of which are expressly incorporated herein by reference.

Preferably, the first and second screw threads are constructed and arranged to permit axial displacement of the closure relative to the neck at least when the closure is at the said intermediate position, and preferably the engageable elements are adapted to engage each other when the closure is axially displaced in a direction emerging from the neck, for example by axial pressure from inside the pressurized container. More preferably, the mutually engageable elements are constructed and arranged not to mutually engage each other when the closure is axially displaced in a direction inwardly towards the neck at the intermediate position, for example when the closure is being screwed down onto the container neck.

Preferably, the mutually engageable elements comprise a step or recess formed in the lower surface of one of the second screw thread segments to provide a first abutment surface against which a second abutment surface on one of the first screw thread segments abuts to block or restrict rotation of the closure in an unscrewing direction at the said intermediate position when the closure is under axial pressure in a direction emerging from the container neck.

More preferably, the second thread segment comprises a first thread portion having a first longitudinal cross section and a second thread portion having a second longitudinal cross section narrower than the first cross section, whereby the first thread segment abuts against the second thread portion. The relatively broad first cross section is preferably adjacent to the circumferentially overlapping region of the second thread segments, resulting in a relatively narrow thread gap in that region.

The assemblies according to the present invention preferably further comprise additional means for forming a pressure-tight seal between the neck and the closure. In certain embodiments the sealing means comprise a compressible liner inside the base portion of the closure for abutting against a lip of the container neck. Preferably, the sealing liner is formed from a compressible elastomer. A circumferential sealing rib may be provided on the lip of the container neck, or inside the base of the closure underneath the sealing liner, in order to optimise compression of the elastomer to achieve a pressure-tight seal. However, preferably, the lip of the container neck is smooth and rounded in order to optimise its user-friendliness.

In other embodiments, the sealing means may comprise a cylindrical sealing plug that projects concentrically and inside the closure skirt and that forms a pressure-tight seal with the inside of the container neck proximate to the opening.

Preferably, the first and second threads on the container neck and closure are variable pitch threads, preferably as described in WO97/21602, the entire contents of which are incorporated herein by reference. Preferably, the pitch of an unscrewing thread path defined by the first and the second thread segments is relatively lower in a first region and relatively higher in a second region displaced from the first region in an unscrewing direction. The pitch of the thread path in the first region is preferably substantially constant. The first region normally includes the position at which the closure is sealed on the container neck. Preferably, the first region extends for 20°-40° about the circumference of the container neck or the closure skirt. Preferably, the pitch of the lower thread surface in the first region is in the range of 1° to 12°, more preferably 2° to 8°.

Preferably, the second region is adjacent to the first region of the thread path. Preferably, the pitch of the helical thread path in the second region is substantially constant, and the second region preferably extends for 15° to 35° about the circumference of the container neck or the closure skirt. Preferably, the pitch of the thread path in the second region is in the range of 15° to 35°.

The use of a variable pitch thread renders it easier to combine fast-turn threads having a steep average pitch that are elderly-and child-friendly with pressure safety. A problem that could arise with fast-turn threads is that they are steeply pitched, which results in a tendency to back off from the fully secured position on the container neck when the container is pressurized. This problem can be overcome by using bayonet-type threads, but the use of bayonet-type threads results in a number of different problems, as described above. In contrast, the variable pitch threads solve the problem of backing off of the closure under pressure, whilst retaining all of the advantages of continuous, fast-turn threads.

Preferably, the helical unscrewing thread path further comprises a third region adjacent to the second region, wherein the third region has a relatively low pitch. Preferably, the third region has a relatively constant pitch, preferably in the range 1 to 12°, more preferably 2 to 8°. The third region preferably includes the position of the closure on the container neck when the closure is blocked at the intermediate gas venting position. The relatively low pitch of the third region reduces the tendency of the closure to override the blocking means at high gas venting pressures.

Preferably, the closure assembly includes a recess in the inner surface of the closure skirt, the recess being located between and circumferentially overlapping two of the plurality of second thread segments to increase the cross-sectional area provided for gas venting between the second thread segments.

It has been found that the thread gap between overlapping portions of adjacent second thread segments may have a cross-section that is too small for optimal gas venting in all circumstances. The recess overcomes this difficulty by increasing the cross-section of the thread gap to increase the rate of gas venting through the thread gap.

The increased cross-sectional area of the venting pathway in the circumferentially overlapping regions of the second thread permits faster venting of pressure from inside the container, and thereby reduces the length of time that the closure is blocked at the intermediate position while venting takes place, without any loss of pressure safety.

Preferably, the recess comprises an elongate groove extending around the the closure skirt between the second thread segments in the said overlapping regions. Preferably, the elongate groove extends substantially parallel to the helical thread path. Preferably, the recess comprises an elongate groove in the inside of the closure skirt. Preferably, the longitudinal cross-sectional area of the recess is from 5% to 50% of the mean longitudinal cross-sectional area of the second thread segment portions adjacent to the recess.

In a second aspect, the present invention provides a closure cap for a container closure assembly, said cap comprising a base portion and a skirt portion having a screw thread defined by a plurality of screw thread segments projecting inwardly from the skirt and extending radially at least about 90° around the skirt, wherein the thread segments are each made up of a plurality of radially spaced projecting portions, each said portion extending radially no more than about 60° around the closure skirt.

The preferred features of the closure cap according to this aspect of the invention are as hereinbefore described in relation to the first aspect of the invention. Preferably, the closure cap is formed from thermoplastics by injection molding.

Specific embodiments of the container closure assemblies according to the present invention will now be described further, by way of example, with reference to the accompanying drawings, in which:

BRIEF DESCRIPTION OF THE SEVERAL VIEWS OF THE DRAWING(S)

DETAILED DESCRIPTION OF THE INVENTION

Figure 1:
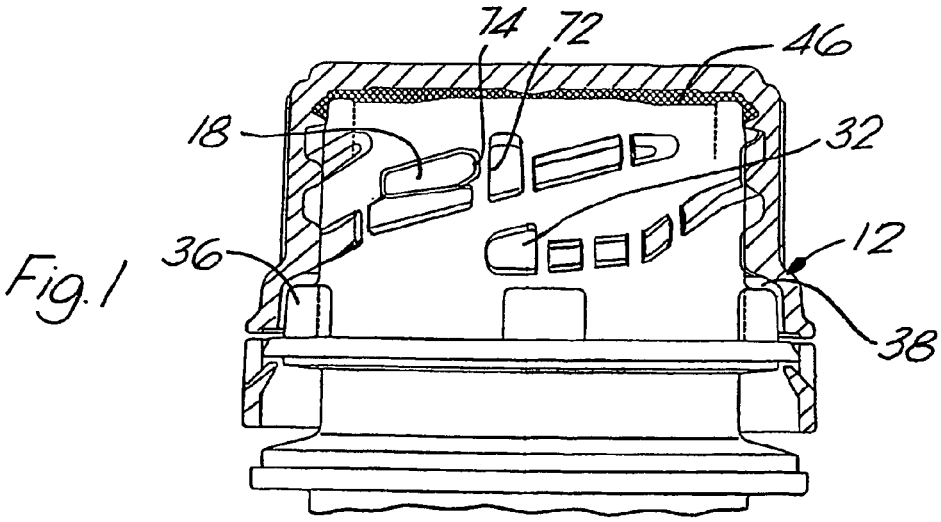
FIG. 1 shows a view of a container closure assembly according to the present invention with the closure in the fully engaged position on the container neck, in which the neck is shown in elevation and the closure is shown with the skirt partially cut away to show the threads on the container neck.
Figure 2:
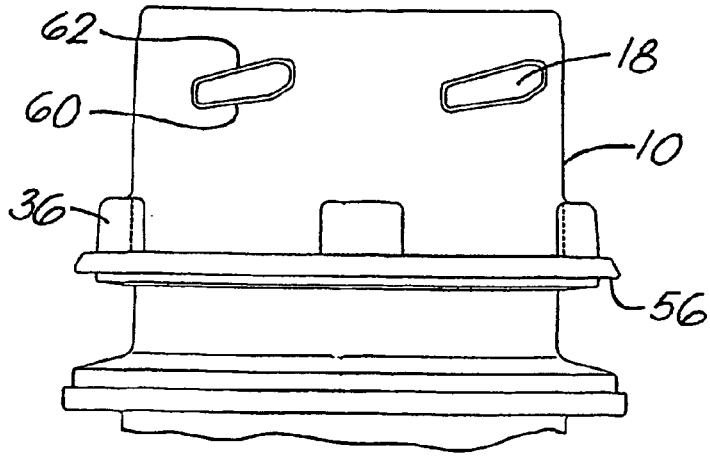
FIG. 2 shows a side elevation view of the container neck of the closure assembly of FIG. 1 after removal of the closure.

Referring to FIGS. 1 and 2, this embodiment is a container closure assembly especially adapted for a carbonated beverage container. The main features of this assembly resemble those of the assembly described and claimed in our International Patent Applications WO95/05322 and WO97/21602 and WO99/19228, the entire contents of which are expressly incorporated herein by reference. However, it is important to note that the threads on the closure and the neck are reversed in the present invention relative to the closure assemblies described in those applications. That is to say, the earlier patent specifications describe in detail assemblies having short thread segments in the closure skirt and longer thread segments on the neck, whereas the present invention provides only short thread segments on the neck and longer thread segments on the closure skirt.

The assembly includes a container neck 10 of a container for carbonated beverages, and a closure 12. Both the container neck and the closure are formed from plastics material. The container is preferably formed by injection molding and blow molding of polyethylene terephthalate in the manner conventionally known for carbonated beverage containers. The closure is preferably formed by injection molding of polypropylene.

Figure 3:
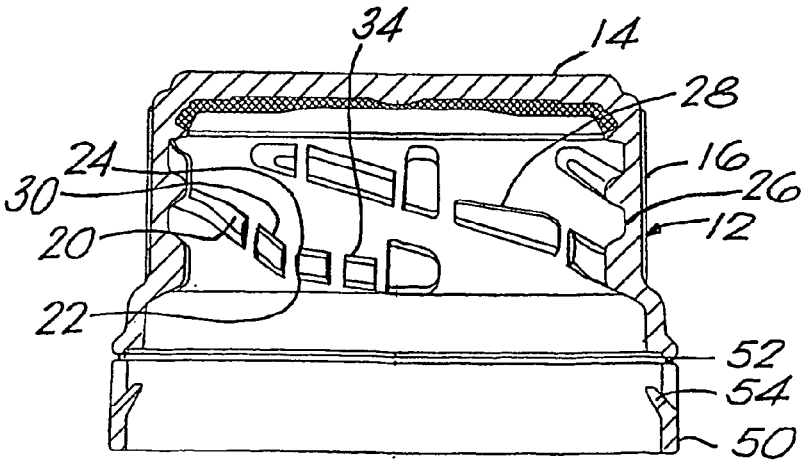
FIG. 3 shows a cross section through the closure only of the assembly of FIG. 1.
Figure 4:
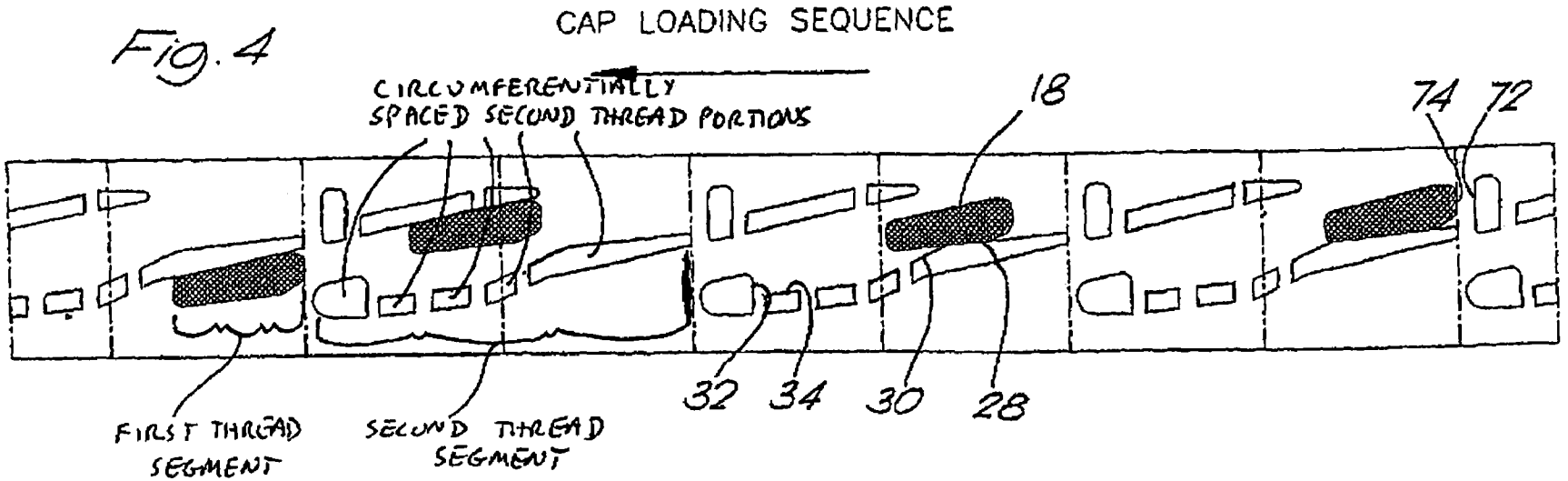
FIG. 4 shows a plane projection of the screw threads of the closure skirt of the assembly of FIG. 1, with the screw threads of the neck shown hatched at a sequence of positions as occupied during closure loading.
Figure 5:
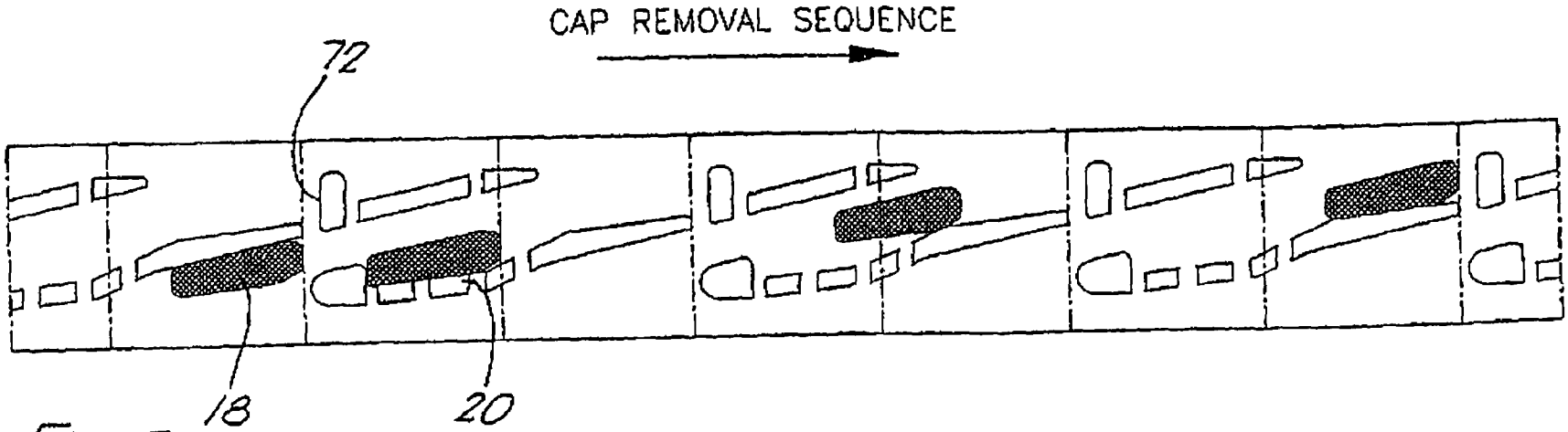
FIG. 5 shows a similar projection to FIG. 4, but with the screw threads of the neck shown hatched at a sequence of positions occupied during closure removal.

On the container neck 10 there is provided a four-start first screw thread made up of four first thread segments 18, as shown in FIG. 2 and in hatched in the thread developments of FIGS. 3-5. The first thread segments 18 are short thread segments extending about 33° around the neck and having a lower surface 60 with relatively low pitch of about 6° and an upper surface 62 with intermediate pitch of about 13.5°. The first thread segments present a substantially trapezoidal cross-section along the axis of the neck. The container neck has a rounded lip to enhance the user-friendliness of the neck.

Referring to FIGS. 1 and 3, the closure 12 comprises a base portion 14 and a skirt portion 16. The closure skirt 12 is provided with a second screw thread formed from four second thread segments 20, each of which is made up of four radially spaced portions separated by gaps and each having a lower thread surface 22 and an upper thread surface 24. (The term "upper" in this context means closer to the base of the closure, i.e. further from the open end of the closure). The upper and lower second thread surfaces 22, 24 give the thread segments substantially trapezoidal side edges that are complementary to the shape of the first thread segments. A substantially continuous, approximately helical thread gap 26 is defined between overlapping regions of the said upper and lower surfaces 22, 24 on adjacent second thread segments 20.

It can be seen that the top and bottom portions of adjacent second thread segments 20 are circumferentially overlapping over part of their length.

An important feature of this assembly is the profiling of the upper surfaces 24 of the second thread segments 20, which is described in more detail in our International patent application WO97/21602. The upper thread surfaces 24 in a first, upper region 28 have a substantially constant pitch of only about 6°. The upper region 28 adjoins an intermediate region 30 having a substantially constant, much higher pitch of about 25°. The average pitch of the helical thread path defined by the second thread segments 20 is 13.5°.

The second thread segments 20 also include a pressure safety feature similar to that described and claimed in our International Patent Application WO95/05322. Briefly, the lowermost portion of the second thread segment 20 defines a step to abut against an end of the first thread segments 18 and block unscrewing of the closure 12 from the neck 10 when the said first thread segments 18 are in abutment with the upper surface 24, i.e. when there is a net force on the closure in an axial direction out of the container neck. A third region 34 of the upper surfaces 24 of the second thread segments situated adjacent to the step 32 also has a low pitch of about 6°.

The container and closure assembly is also provided with complementary locking elements on the container neck and the closure to block unscrewing of the closure from the fully engaged position on the container neck unless a minimum unscrewing torque is applied. These locking elements comprise four equally radially spaced locking ribs 36 on the container neck, and four equally radially spaced retaining ramps 38 on the inside of the closure skirt 16. The ramps 38 comprise a radially sloped outer face 40 and a radially projecting retaining edge 44 against which the rib 36 on the closure abuts when the closure is fully engaged on the container neck. The complementary locking means may be as described in our International Patent Application WO91/18799, the entire content of which is hereby expressly incorporated by reference. However, the locking rib is on the container neck and not on the closure in this embodiment, which also helps to improve the user-friendliness of the container neck finish, especially with a suitably smoothed rib.

The container and closure assembly also comprises means for forming a gas-tight seal between the closure and the container neck. This means may comprises a gas-tight elastomeric sealing liner 46 that is compressed against the lip of the container neck. Optimum sealing is preferably achieved when the elastomeric sealing liner is compressed to between 30% and 70% of its original thickness. In other embodiments, sealing may be achieved without the need for a liner, for example by compression of suitably configured circumferential sealing ribs or fins on the closure cap against the container neck.

The second thread segments 20 terminate at their lower end in a projecting portion that defines a longitudinal shoulder 72 forming a first stop against which a second end 74 of the first thread segments 18 may abut thereby to block overtightening of the closure on the neck.

The container closure assembly also comprises a tamper-evident safety feature. This consists of a tamper-evident ring 50 that is initially formed integrally with the skirt 16 of the container closure 12 and joined thereto by frangible bridges 52. The tamper-evident ring 50 comprises a plurality of integrally formed, flexible, radially inwardly pointing retaining tabs 54. A circumferential retaining lip 56 is provided on the container neck 10. Ratchet projections (not present in this embodiment) may also be provided on the container neck below the circumferential retaining lip 56 and radially spaced around the container neck to block rotation of the tamper-evident ring 50 on the container neck 10 in an unscrewing direction. However, it may be preferred to smooth or omit the ratchet projections in order to improve user-friendliness of the neck finish. The structure and operation of the tamper-evident ring feature are as described and claimed in our International Patent Application WO94/11267, the entire contents of which are expressly incorporated herein by reference.

In use, the closure 12 is secured onto the container neck 10 by screwing down in conventional fashion. The closure 12 can be moved from a fully disengaged position to a fully engaged position on the container neck 10 by rotation through about 90°. When the closure is being screwed down, there is normally a net axial force applied by the user on the closure into the container neck, and accordingly the first thread segments 18 abut against and ride along the upper surfaces 22 of the projecting portions of the second thread segments 20 on the closure skirt, as shown in FIG. 4. It can thus be seen that the first thread segments follow a substantially continuous path along a variable pitch helix. The first and second threads are free-running, which is to say that there is substantially no frictional torque between the thread segments until the fully engaged position is neared. These features of a 90° closure rotation, substantially continuous thread path and free-running threads all make the closure extremely easy to secure on the container neck, especially for elderly or arthritic persons, or children.

As the closure nears the fully engaged position on the container neck 10, several things happen. Firstly, the tamper-evident ring 50 starts to ride over the retaining lip 56 on the container neck. The retaining tabs 54 on the tamper-evident ring 50 flex radially outwardly to enable the tamper-evident ring to pass over the retaining lip 56 without excessive radial stress on the frangible bridges 52.

Secondly, the locking ribs 36 on the container neck ride up the outer ramped surface 40 of the retaining ramps 38 on the closure skirt 16. The gentle slope of the ramped surfaces 40, together with the resilience of the closure skirt 16, mean that relatively little additional torque is required to cause the locking ribs 36 to ride up the ramped surfaces 40.

Thirdly, the initial abutment between the sealing liner 46 in the container closure base and the sealing lip 48 on the container neck results in a net axial force on the closure in a direction out of the container neck. This pushes the thread segments 18 out of abutment with the lower surfaces 22 of the projecting portions of the second thread segments 20 and into abutment with the upper surfaces 24 of the projecting portions of the second thread segments 20. More specifically, it brings the first thread segments 18 into abutment with the upper regions 28 of the projecting portions of the upper thread surfaces 24. Continued rotation of the closure in a screwing-down direction causes the first thread segments 18 to travel along the upper regions 28 until the final, fully engaged position shown in FIG. 4 is reached. The low pitch of the upper surfaces 28 means that this further rotation applies powerful leverage (camming) to compress the sealing liner 46 against the sealing rib 48 in order to achieve an effective gas-tight seal.

When the fully engaged position of the closure 12 on the container neck 10 is reached, the locking ribs 36 click over the top of the respective ramped surfaces 40 and into abutment with the steep retaining surfaces of the ratchet ramps 38. At the same position, the second ends 74 of the first thread segments 18 may come into abutment with the stop shoulders 72 at the top of the second thread segments, thereby blocking further tightening of the closure than could damage the threads and/or over-compress the sealing liner.

When the closure 12 is in the fully engaged position on the container neck 10, the upper surfaces 60 of the first thread segments 16 abut against the upper regions 28 of the upper thread surfaces 24 of the projecting portions of the second thread segment 20, as shown in FIG. 3. The upper surface of the first thread segments has a low pitch to match that of the upper regions 28, so as to maximise the contact area between the projecting portions in the regions 28, and thereby distribute the axial force exerted by the closure as evenly as possible around the container neck. Because of the low pitch in the regions 28, relatively little of the axial force emerging from the container neck due to pressure inside the container is converted into unscrewing rotational force by the abutment between the thread surfaces in this position. This greatly reduces the tendency of the closure to unscrew spontaneously under pressure. Spontaneous unscrewing is also prevented by the abutment between the locking ribs 36 and the retaining edge 44 on the locking ramps 38. An important advantage of the assembly is that the reduced tendency to unscrew spontaneously due to the low pitch of the thread in the lower regions 28 means that the minimum opening torque of the locking elements 36,38 can be reduced without risk of the closure blowing off spontaneously. This makes the closure easier to remove by elderly or arthritic people, or by children, without reducing the pressure safety of the closure.

In use, the closure is removed from the container neck by simple unscrewing. The unscrewing thread path followed by the short thread segments on the container neck is illustrated in FIG. 5. An initial, minimum unscrewing torque is required to overcome the resistance of the locking elements 36, 38. Once this resistance has the closure. The internal pressure inside the container exerts an axial force on the closure in a direction emerging from the mouth of the container, as a result of which the first thread segments 18 ride along the upper surfaces 28 of the projecting portions of the second thread segments 20 as the closure is unscrewed the steeply pitched intermediate regions 30 of the upper surface of the second thread segments 20. The first thread segments 18 then come into abutment with lower projecting portion of the second thread segments 20, as shown in FIG. 5. In this position, further unscrewing of the closure is blocked while gas venting takes place along the thread paths 26. It should also be noted that, in this intermediate gas venting position, the first thread segments 18 abut primarily against the region 34 of the upper surface of the second thread segments 20. The low pitch of this region 34 results in relatively little of the axial force on the closure being converted into unscrewing rotational torque, thereby reducing the tendency of the closure to override the pressure safety feature and blow off.

Once gas venting from inside the container neck is complete so that there is no longer axial upward force on the closure, the closure can drop down so as to bring the thread segments 18 into abutment with the lower surfaces 22 of the second thread segments 20. In this position, unscrewing can be continued to disengage the closure completely from the container neck as shown in FIG. 5.

The above embodiment has been described by way of example only. Many other embodiments of the present invention falling within the scope of the accompanying claims will be apparent to the skilled reader. In particular, the present invention is not limited to carbonated beverage containers, or to containers formed from molded thermoplastics.

The invention claimed is:

1. A threaded container closure assembly, said assembly comprising:

a container neck having an opening;

a closure for said neck, the closure having a base portion and a skirt portion;

a first screw thread on the neck, said first screw thread comprising one or more first thread segments;

a second screw thread on an inner surface of the skirt of the closure, said second screw thread comprising one or more second thread segments;

said first and second screw threads being configured to enable a user to secure, remove and resecure the closure into a sealing position on the neck by rotation of the closure on the neck by a continuous smooth rotation through about 90° or less;

wherein said first thread segments are shorter than said second thread segments; and wherein the second thread segments are each made up of one or more circumferentially spaced projecting portions, each said portion extending radially no more than about 60° around the closure skirt, the second thread segments forming a substantially continuous helical thread path.

2. A container closure assembly according to claim 1, wherein there are at least two of said first thread segments.

3. A container closure assembly according to claim 2, wherein there are four or more of said first thread segments.

4. A container closure assembly according to claim 1, wherein at least one of the first thread segments extends circumferentially from 5 to 60 degrees around the container neck.

5. A container closure assembly according to claim 4, wherein at least one of the first thread segments extends circumferentially from 10 to 45 degrees around the container neck.

6. A container closure assembly according to claim 1, wherein at least one of the first thread segments has an upper or a lower surface with a mean pitch of from 5° to 25°.

7. A container closure assembly according to claim 1, wherein at least one of the first thread segments has an upper or a lower surface with a constant pitch region extending for at least 5° around the container neck.

8. A container closure assembly according to claim 1, wherein at least one of the second thread segments extends for at least 60° around the closure skirt.

9. A container closure assembly according to claim 1, wherein at least one of the second thread segments is made up of two or more projecting portions.

10. A container closure assembly according to claim 1, wherein the radially spaced projecting portions each extend less than about 45° around the closure skirt.

11. A container closure assembly according to claim 1, wherein the radially spaced projecting portions are radially spaced apart by gaps extending radially from 0 to about 10°.

12. A container closure assembly according to claim 1, wherein the maximum radial height of the first and/or the second thread segments is from about 0.5 to about 3 mm.

13. A container closure assembly according to claim 1, further comprising mutually engageable elements on the neck and the closure to block or restrict rotation of the closure in an unscrewing direction beyond an intermediate position when the closure is under axial pressure in a direction emerging from the container neck.

14. A container closure assembly according to claim 1, wherein the second thread segments define a substantially continuous helical thread path along which said first thread segments travel from a substantially fully disengaged to a substantially fully secured position of the closure on the container neck.

15. A container closure assembly according to claim 14, wherein the mean pitch of said helical thread path is from 5 to 20 degrees.

16. A container closure assembly according to claim 1, wherein the second thread segments define at least one recess for receiving said first thread segments, said recess being substantially helical and extending for more than 45 degrees around the closure skirt.

17. A container closure assembly according to claim 1, wherein there are four or more of the second thread segments.

18. A container closure assembly according to claim 1, wherein at least one of the second thread segments has a smoothed cross section.

19. A container closure assembly according to claim 1, wherein the first thread segments have a cross-section along the longitudinal cross-section of the assembly that is rounded, chamfered, trapezoidal or triangular.

20. A container closure assembly according to claim 1, wherein the closure can be moved from a fully released to a fully engaged position on the container neck by a single smooth rotation through about 360 degrees or less.

21. A container closure assembly according to claim 20, wherein the closure can be moved from a fully released to a fully engaged position on the container neck by a single smooth rotation through about 180 degrees or less.

22. A container closure assembly according to claim 21, wherein the closure can be moved from a fully released to a fully engaged position on the container neck by a single smooth rotation through about 90 degrees or less.

23. A container closure assembly according to claim 1, further comprising complementary locking means on the container neck and the closure that resist unscrewing of the closure form the fully engaged position on the container neck after the closure has been secured or resecured on the container neck until a predetermined minimum opening torque is applied.

24. A container closure assembly according to claim 23, wherein the locking means on the container neck comprises a projection or recess for engagement with a complementary projection or recess on the closure skirt.

25. A container closure assembly according to claim 1, wherein the container neck is formed from a material selected from the group consisting of thermoplastics, glass, metal, and combinations thereof.

26. A container closure assembly according to claim 1 in which the first thread segments are helical and have rounded ends.

* * * * *